US010840009B2

(12) United States Patent
Kido

(10) Patent No.: US 10,840,009 B2
(45) Date of Patent: Nov. 17, 2020

(54) INDUCTOR COMPONENT

(71) Applicant: Murata Manufacturing Co., Ltd., Kyoto (JP)

(72) Inventor: Tomohiro Kido, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 339 days.

(21) Appl. No.: 15/846,589

(22) Filed: Dec. 19, 2017

(65) Prior Publication Data

US 2018/0197675 A1 Jul. 12, 2018

(30) Foreign Application Priority Data

Jan. 10, 2017 (JP) ..... 2017-001897

(51) Int. Cl.
*H01F 27/28* (2006.01)
*H01F 27/29* (2006.01)
(Continued)

(52) U.S. Cl.
CPC ..... *H01F 27/292* (2013.01); *H01F 17/0013* (2013.01); *H01F 27/2804* (2013.01);
(Continued)

(58) Field of Classification Search
CPC ..... H01F 27/292; H01F 17/0013; H01F 27/2804; H01F 27/323; H01F 41/122;
(Continued)

(56) References Cited

U.S. PATENT DOCUMENTS 7,176,772 B2 * 2/2007 Maeda ..... H01F 17/0013 336/200
10,490,349 B2 * 11/2019 Lee ..... H01F 41/043
(Continued)

FOREIGN PATENT DOCUMENTS

CN 106257603 A 12/2016
JP 2006-32430 A 2/2006
JP 2014-039036 A 2/2014

OTHER PUBLICATIONS

An Office Action mailed by the Chinese Patent Office on Apr. 3, 2019, which corresponds to Chinese Patent Application No. 201810010764. 7 and is related to U.S. Appl. No. 15/846,589 with English language translation.
(Continued)

*Primary Examiner* — Tuyen T Nguyen
(74) *Attorney, Agent, or Firm* — Studebaker & Brackett PC

(57) ABSTRACT

An inductor component has an element body, a coil disposed in the element body, and first and second external electrodes disposed in the element body and electrically connected to the coil. The element body includes a first end surface and a second end surface opposite to each other and a bottom surface connected between the first end surface and the second end surface. The first external electrode is formed on the first end surface side of the bottom surface while the second external electrode is formed on the second end surface side of the bottom surface. A first end of the coil is connected to an end portion on the first end surface side of the first external electrode while a second end of the coil is connected to an end portion on the second end surface side of the second external electrode.

10 Claims, 9 Drawing Sheets

(51) Int. Cl.

| | |
|---|---|
| ***H01F 27/32*** | (2006.01) |
| ***H01F 41/12*** | (2006.01) |
| ***H01F 41/10*** | (2006.01) |
| ***H01F 41/04*** | (2006.01) |
| ***H01F 17/00*** | (2006.01) |

(52) U.S. Cl.
CPC ..... *H01F 27/323* (2013.01); *H01F 41/043* (2013.01); *H01F 41/10* (2013.01); *H01F 41/122* (2013.01); *H01F 2027/2809* (2013.01)

(58) Field of Classification Search
CPC ..... H01F 41/10; H01F 41/043; H01F 2027/2809; H01F 27/28; H01F 27/327; H01F 2017/0073
See application file for complete search history.

(56) References Cited

U.S. PATENT DOCUMENTS

| | | | | |
|---|---|---|---|---|
| 2014/0078643 | A1* | 3/2014 | Odahara ..... | H01F 17/0013 361/306.3 |
| 2014/0253277 | A1* | 9/2014 | Takezawa ..... | H01F 27/2804 336/200 |
| 2016/0042858 | A1 | 2/2016 | Park et al. | |

OTHER PUBLICATIONS

An Office Action; "Notification of Reasons for Refusal," mailed by the Japanese Patent Office dated Mar. 5, 2019, which corresponds to Japanese Patent Application No. 2017-001897 and is related to U.S. Appl. No. 15/846,589; with English language translation.

* cited by examiner

INDUCTOR COMPONENT

CROSS REFERENCE TO RELATED APPLICATIONS

This application claims benefit of priority to Japanese Patent Application 2017-001897 filed Jan. 10, 2017, the entire content of which is incorporated herein by reference.

TECHNICAL FIELD

The present disclosure relates to an inductor component.

BACKGROUND

A conventional inductor component is described in Japanese Laid-Open Patent Publication No. 2014-39036. This inductor component has an element body, a coil disposed in the element body, and first and second external electrodes disposed on the element body and electrically connected to the coil.

The element body includes a first end surface and a second end surface opposite to each other and a bottom surface connected between the first end surface and the second end surface. The first external electrode is formed on the first end surface side of the bottom surface and the second external electrode is formed on the second end surface side of the bottom surface. The coil is helically wound in a direction parallel to the first end surface, the second end surface, and the bottom surface. A first end of the coil is connected to a first end on the second end surface side of the first external electrode (the inner side of the inductor component), and a second end of the coil is connected to a first end on the first end surface side of the second external electrode (the inner side of the inductor component).

SUMMARY

Problem to be Solved by the Disclosure

It was found that the following problem exists when the conventional inductor component is mounted on a mounting board. When the inductor component is mounted on a mounting board, each of the first and second external electrodes of the inductor component is connected to a wiring of the mounting board. The wiring of the mounting board is laid out in a shape acquired by extending a straight line passing directly under each of the first and second external electrodes to the outside of the inductor component basically without unnecessary routing. Therefore, signals are input/output from the first and second end surface sides of the inductor component to the inductor component. In this case, a current flows between the first end on the second end surface side and the second end on the first end surface side in the first external electrode, and a current flows between the first end on the first end surface side and the second end on the second end surface side in the second external electrode.

Thus, the current transmitted from the mounting board to the inductor component cannot flow into/out of the coil unless flowing between the first end and the second end in each of the first and second external electrodes. Consequently, the line length of the current becomes longer in the first external electrode and the second external electrode, resulting in an increase in loss and a decrease in the Q value.

Therefore, a problem to be solved by the present disclosure is to provide an inductor component capable of suppressing an increase in loss and improving the Q value.

Solutions to the Problems

To solve the problem, the present disclosure provides an inductor component comprising:

an element body;

a coil disposed in the element body; and first and second external electrodes disposed in the element body and electrically connected to the coil, wherein the element body includes a first end surface and a second end surface opposite to each other and a bottom surface connected between the first end surface and the second end surface, wherein the first external electrode is formed on the first end surface side of the bottom surface while the second external electrode is formed on the second end surface side of the bottom surface, and wherein a first end of the coil is connected to an end portion on the first end surface side of the first external electrode while a second end of the coil is connected to an end portion on the second end surface side of the second external electrode.

According to the inductor component of the present disclosure, the first end of the coil is connected to the end portion on the first end surface side of the first external electrode and the second end of the coil is connected to the end portion on the second end surface side of the second external electrode. When the inductor component is mounted on a mounting board, the first external electrode and the second external electrode are connected to wirings of the mounting board. When a current is applied between the coil and the mounting board, the current only needs to flow near the end portion before being able to flow into/out of the coil in each of the first and second external electrodes. Since this makes the line length of the current shorter in the first external electrode and the second external electrode, an increase in loss can be suppressed and the Q value can be improved.

In an embodiment of the inductor component, the coil has a winding part wound in a helical shape, a first lead-out part connected between a first end of the winding part and the end portion on the first end surface side of the first external electrode, and a second lead-out part connected between a second end of the winding part and the end portion on the second end surface side of the second external electrode.

According to the embodiment, since the coil has the winding part, the first lead-out part, and the second lead-out part, the shape design of the winding part and the shape design of the first and second external electrodes can be made independent of each other, so that a degree of freedom in design is improved.

In an embodiment of the inductor component, when viewed in a direction parallel to the first end surface, the second end surface, and the bottom surface, an angle formed by the first lead-out part and the first external electrode and an angle formed by the second lead-out part and the second external electrode are acute angles.

According to the embodiment, when a current flows from the mounting board to the inductor component, for example, the current flows from the first end surface side of the element body toward the inside of the element body through the first external electrode. The current then passes through the first external electrode and flows through the first lead-out part. Since the angle formed by the first lead-out part and the first external electrode is an acute angle, the direction of the current does not change at a sharp angle, so that a loss due to reflection and eddy current can be reduced.

On the other hand, when a current flows from the inductor component to the mounting board, the current passes through the second lead-out part and the second external electrode and flows from the inside of the element body toward the second end surface side of the element body. Since the angle formed by the second lead-out part and the second external electrode is an acute angle, the direction of the current does not change at a sharp angle, so that a loss due to reflection and eddy current can be reduced.

Therefore, since the current can smoothly flow, an increase in the reflection loss of the current can be suppressed and the Q value can be improved. Although the current flows from the first external electrode in the order of the first lead-out part, the winding part, the second lead-out part, and the second external electrode in the description, the same applies to when the current flows in the opposite direction.

In an embodiment of the inductor component, the winding part is helically wound in an axial direction parallel to the bottom surface.

According to the embodiment, since the axial direction of the winding part is parallel to the bottom surface, the first and second external electrodes formed in the bottom surface has a structure hardly blocking the magnetic flux generated by the winding part, so that the loss can further be reduced.

In an embodiment of the inductor component, when viewed in the axial direction of the winding part, the first lead-out part is connected to the winding part between a first position at which the first lead-out part intersects the winding part in a shortest distance and a second position at which the first lead-out part is tangent to the winding part, and wherein the second lead-out part is connected to the winding part between a first position at which the second lead-out part intersects the winding part in a shortest distance and a second position at which the second lead-out part is tangent to the winding part.

According to the embodiment, when the first lead-out part intersects the winding part in the shortest distance, the length of the first lead-out part can be minimized and a loss increase associated with an increase in the line length can be suppressed. On the other hand, when the first lead-out part is tangent to the winding part, a current flow can be smoothened between the first lead-out part and the winding part.

Similarly, when the second lead-out part intersects the winding part in the shortest distance, the length of the second lead-out part can be minimized and a loss increase associated with an increase in the line length can be suppressed. On the other hand, when the second lead-out part is tangent to the winding part, a current flow can be smoothened between the second lead-out part and the winding part.

Therefore, when the first lead-out part and the second lead-out part are connected to the winding part between the first position and the second position, the line lengths of the first and second lead-out parts and the smoothness of the current flow can be balanced.

In an embodiment of the inductor component, the winding part is helically wound in an axial direction parallel to the first end surface, the second end surface, and the bottom surface.

According to the embodiment, since the axial direction of the winding part is parallel to the first end surface, the second end surface, and the bottom surface, for example, the direction of current flow from the first external electrode to the first lead-out part and the direction of current flow from the first lead-out part to the winding part do not become opposite to each other, so that a loss due to reflection and eddy current can be reduced. The same applies to the direction of the current flowing sequentially through the winding part, the second lead-out part, and the second external electrode.

In an embodiment of the inductor component, the first lead-out part and the second lead-out part extend from the bottom surface of the element body toward a top surface opposite to the bottom surface of the element body.

According to the embodiment, since the first lead-out part and the second lead-out part extend from the bottom surface toward the top surface, the number of turns of the coil can be increased as compared to when the first lead-out part and the second lead-out part extend along the bottom surface.

In an embodiment of the inductor component, the winding part includes a coil conductor layer wound in a planar shape.

According to the embodiment, the inductor component can be a laminated inductor.

In an embodiment of the inductor component, the first external electrode is exposed from the first end surface of the element body while the second external electrode is exposed from the second end surface of the element body.

According to the embodiment, the first external electrode is exposed from the first end surface and the second external electrode is exposed from the second end surface. Consequently, when the inductor component is mounted on the mounting board by solder, the solder is bonded also on the first end surface side of the first external electrode and the second end surface side of the second external electrode. Therefore, the fixing strength of the inductor component to the mounting board can be ensured.

In an embodiment of the inductor component, the first external electrode is covered with the first end surface of the element body while the second external electrode is covered with the second end surface of the element body.

According to the embodiment, the first external electrode is covered with the first end surface and the second external electrode is covered with the second end surface. Consequently, when the inductor component is mounted on the mounting board by solder, the solder does not move up to wet the first end surface side of the first external electrode and the second end surface side of the second external electrode. Therefore, the solder does not spread outside the end surfaces of the element body, so that the mounting area of the inductor component including the solder can be reduced with respect to the mounting board.

Effect of the Disclosure

According to the inductor component of the present disclosure, since the line length of the current is shortened in the first external electrode and the second external electrode, the increase in loss can be suppressed and the Q value can be improved.

DETAILED DESCRIPTION

The present disclosure will now be described in detail with reference to shown embodiments.

First Embodiment

Figure 1:
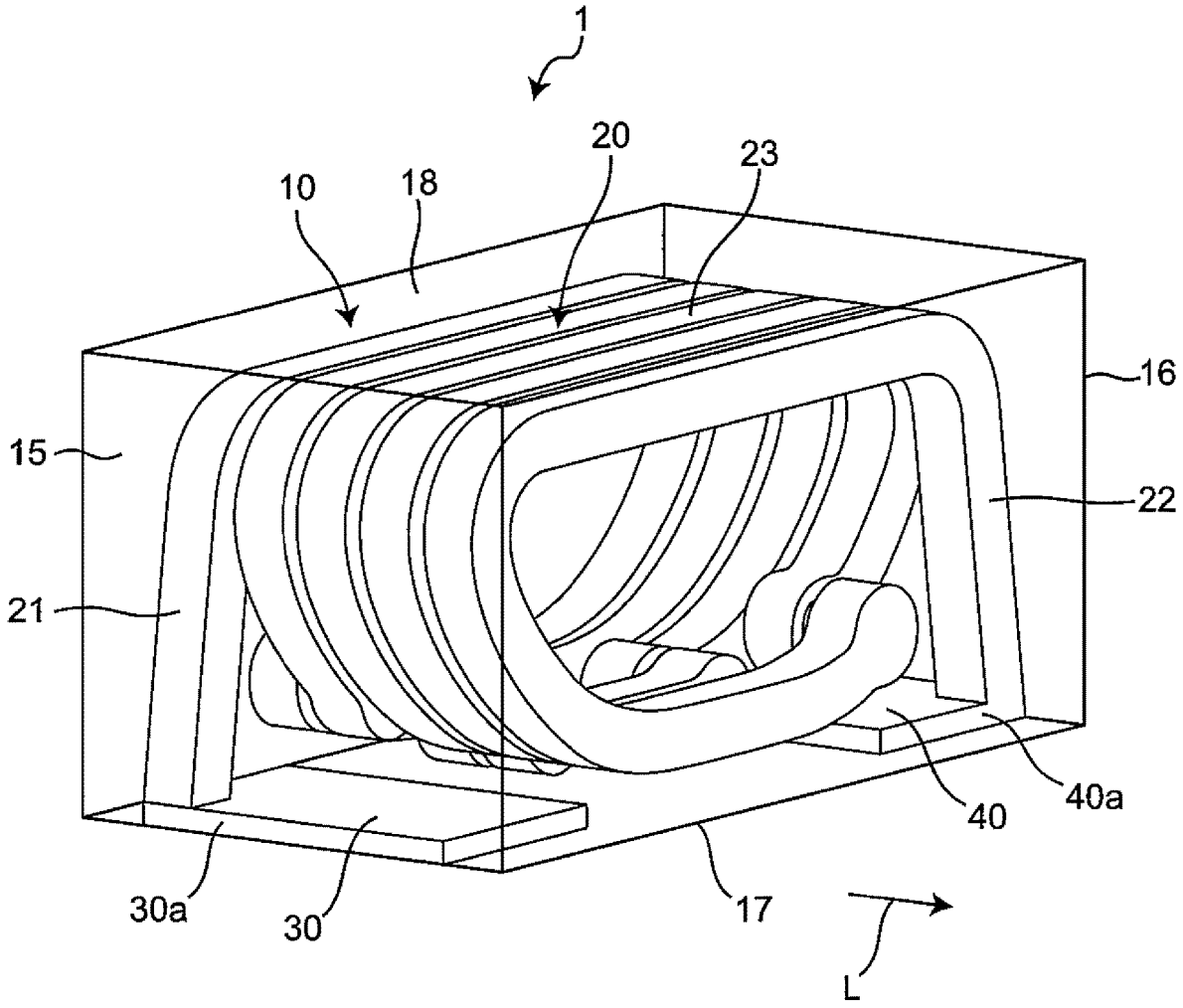
FIG. 1 is a transparent perspective view of a first embodiment of an inductor component of the present disclosure.
Figure 2:
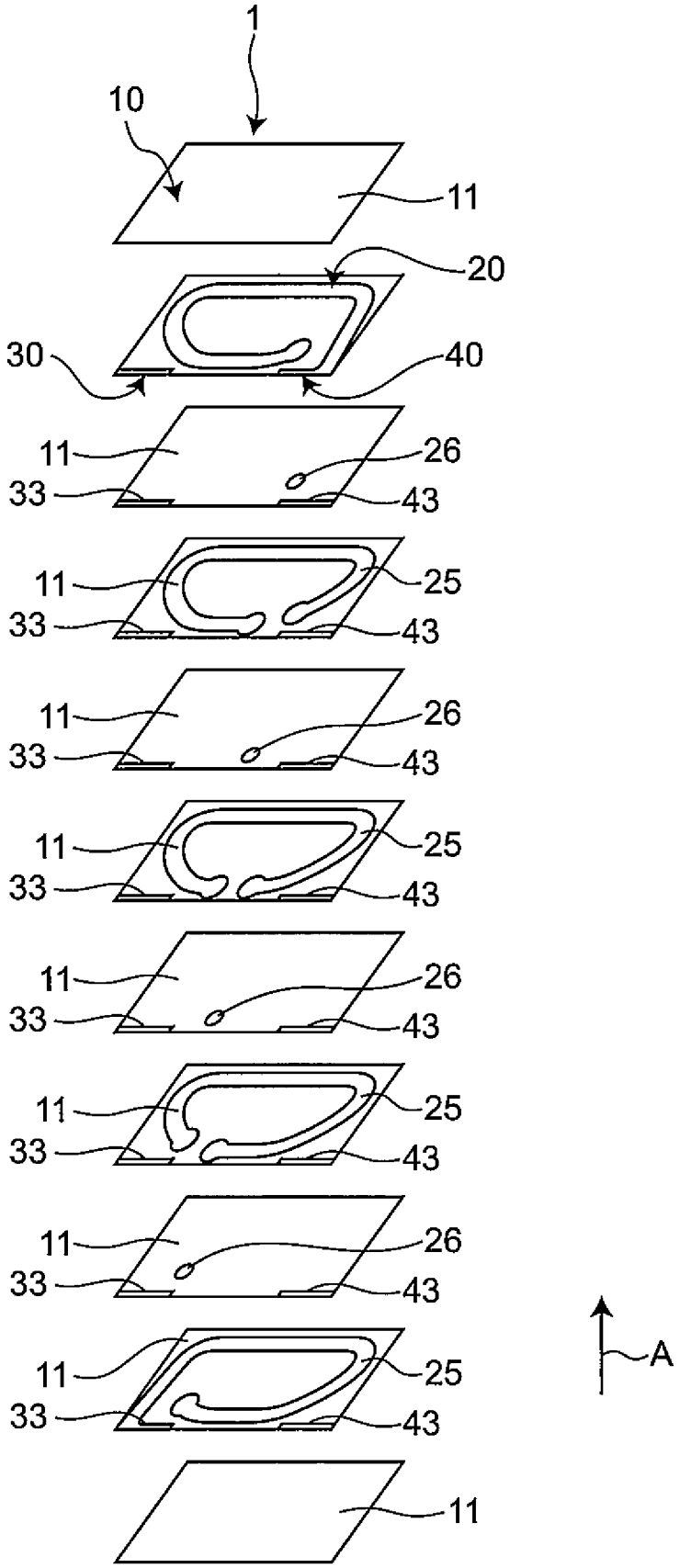
FIG. 2 is an exploded perspective view of the inductor component.
Figure 3:
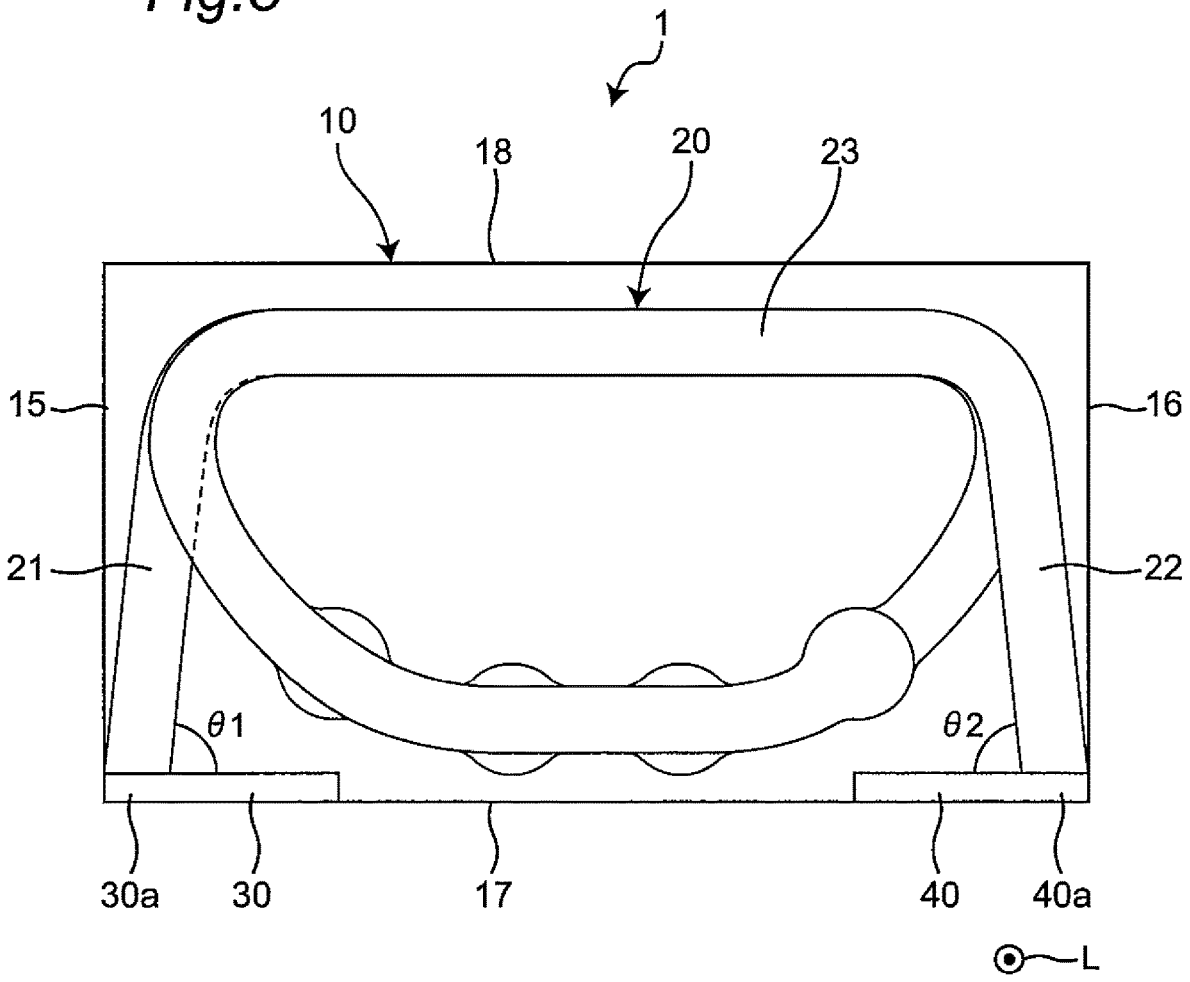
FIG. 3 is a transparent front view of an inductor component.

FIG. 1 is a transparent perspective view of a first embodiment of an inductor component. FIG. 2 is an exploded perspective view of the inductor component. FIG. 3 is a transparent front view of an inductor component. As shown in FIGS. 1, 2, and 3, an inductor component 1 has an element body 10, a helical coil 20 disposed inside the element body 10, and a first external electrode 30 and a second external electrode 40 disposed in the element body 10 and electrically connected to the coil 20. Although depicted as being transparent in FIGS. 1 and 3 so that a structure can easily be understood, the element body 10 may be semitransparent or opaque.

The inductor component 1 is electrically connected via the first and second external electrodes 30, 40 to a wiring of a circuit board not shown. The inductor component 1 is used as an impedance matching coil (matching coil) of a high-frequency circuit, for example, and is used for an electronic device such as a personal computer, a DVD player, a digital camera, a TV, a portable telephone, automotive electronics, and medical/industrial machines. However, the inductor component 1 is not limited to these uses and is also usable for a tuning circuit, a filter circuit, and a rectifying/smoothing circuit, for example.

The element body 10 is formed by laminating multiple insulating layers 11. The insulating layers 11 are made of, for example, a material mainly composed of borosilicate glass or a material such as ferrite and resin. In the element body 10, an interface between the multiple insulating layers 11 may not be clear due to firing, etc. The element body 10 is formed into a substantially rectangular parallelepiped shape. The surface of the element body 10 has a first end surface 15, a second end surface 16 opposite to the first end surface 15, a bottom surface 17 connected between the first end surface 15 and the second end surface 16, and a top surface 18 opposite to the bottom surface 17. The first end surface 15, the second end surface 16, the bottom surface 17, and the top surface 18 are surfaces parallel to a lamination direction A of the insulating layers 11. It is noted that "orthogonal" in this application is not limited to a strictly orthogonal relationship and includes a substantially orthogonal relationship in consideration of a realistic variation range.

The first external electrode 30 and the second external electrode 40 are made of a conductive material such as Ag, Cu, Au, and an alloy mainly composed thereof, for example. The first external electrode 30 is formed on the first end surface 15 side of the bottom surface 17. The second external electrode 40 is formed on the second end surface 16 side of the bottom surface 17.

The first external electrode 30 extends along the bottom surface 17 of the element body 10. The first external electrode 30 is embedded in the element body 10 and exposed from the bottom surface 17. A lower surface of the first external electrode 30 is located on the same plane as the bottom surface 17. Furthermore, the first external electrode 30 is exposed from the first end surface 15. A side surface of the first external electrode 30 is located on the same plane as the first end surface 15.

Similar to the first external electrode 30, the second external electrode 40 extends along the bottom surface 17. Furthermore, similar to the first external electrode 30, the second external electrode 40 is embedded in the element body 10 and exposed from the bottom surface 17 and the second end surface 16.

The first external electrode 30 and the second external electrode 40 have a configuration in which pluralities of first external electrode conductor layers 33 and second external electrode conductor layers 43 embedded in the element body 10 (the insulating layers 11) are laminated. The external electrode conductor layers 33 extend along the bottom surface 17 on the first end surface 15 side and the external electrode conductor layers 43 extend along the bottom surface 17 on the second end surface 16 side. Consequently, since the external electrodes 30, 40 can be embedded in the element body 10, the inductor component can be reduced in size as compared to a configuration in which the external electrodes are externally attached to the element body 10. Additionally, the coil 20 and the external electrodes 30, 40 can be formed in the same steps, so that variations in the positional relationship between the coil 20 and the external electrodes 30, 40 can be reduced to decrease variations in electrical characteristics of the inductor component 1.

The coil 20 is made of the same conductive material as the first and second external electrodes 30, 40, for example. The coil 20 is helically wound along a lamination direction A of the insulating layers 11. A first end of the coil 20 is connected to an end portion 30*a* on the first end surface 15 side of the first external electrode 30 and a second end of the coil 20 is connected to an end portion 40*a* on the second end surface 16 side of the second external electrode 40. In this embodiment, the coil 20 and the first and second external electrodes 30, 40 are integrated without a clear boundary; however, this is not a limitation and the coil and the external electrodes may be made of different materials or by different construction methods so that boundaries may exist.

The coil 20 includes multiple coil conductor layers 25 wound in a planar shape on the insulating layers 11. Since the coil 20 is made up of the coil conductor layers 25 that can be microfabricated in this way, the inductor component 1 can be reduced in size and height. The coil conductor layers 25 adjacent in the lamination direction A are electrically connected in series through via conductor layers 26 penetrating the insulating layers 11 in the thickness direction. The multiple coil conductor layers 25 are electrically connected to each other in series in this way to constitute a helix. Specifically, the coil 20 has a configuration in which the multiple coil conductor layers 25 electrically connected to each other in series and having the number of turns less than one are laminated, and the coil 20 has a helical shape. In this case, a parasitic capacitance generated in the coil conductor layers 25 and a parasitic capacitance generated between the coil conductor layers 25 can be reduced, and the Q-value of the inductor component 1 can be improved.

The coil 20 has a winding part 23, a first lead-out part 21 connected between a first end of the winding part 23 and the first external electrode 30, and a second lead-out part 21 connected between a second end of the winding part 23 and the second external electrode 40. In this embodiment, the winding part 23 and the first and second lead-out parts 21, 22 are integrated without a clear boundary; however, this is not a limitation and the winding part and the lead-out parts may be made of different materials or by different construction methods so that boundaries may exist.

The winding part 23 is made up of the coil conductor layers 25 and the via conductor layers 26 and is helically wound in an axial direction L parallel to the first end surface 15, the second end surface 16, and the bottom surface 17. In the inductor component 1, the axial direction L of the winding part 23 coincides with the laminating direction A of the insulating layer 11. The axis of the winding part 23 (the coil 20) means the central axis of the helical shape of the winding part 23. The axis of the winding part 23 becomes parallel to the first and second external electrodes 30, 40. Consequently, the magnetic fluxes of the coil 20 generated near the first and second external electrodes 30, 40 become parallel to the first and second external electrodes 30, 40. Therefore, a proportion of the magnetic fluxes blocked by the first and second external electrodes 30, 40 can be reduced and an eddy current loss generated by the first and second external electrodes 30, 40 is reduced, so that a reduction in the Q value of the coil 20 can be suppressed.

Although the winding part 23 is formed in a substantially oval shape when viewed in the axial direction L, this shape is not a limitation. The shape of the winding part 23 may be, for example, circular, elliptical, rectangular, another polygonal shape, etc.

Figure 4:
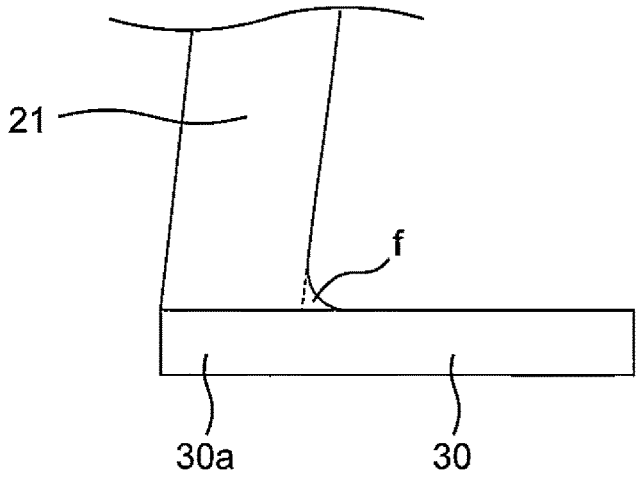
FIG. 4 is an enlarged view of a state in which a fillet is disposed in a portion of a first lead-out part connected to a first external electrode.

The first lead-out part 21 is connected to the end portion 30*a* on the first end surface 15 side of the first external electrode 30. The second lead-out part 22 is connected to the end portion 40*a* on the second end surface 16 side of the second external electrode 40. As shown in FIG. 3, when viewed in the axial direction L of the winding part 23, a first angle θ1 formed by the first lead-out part 21 and the first external electrode 30 and a second angle θ2 formed by the second lead-out part 22 and the second external electrode 40 are acute angles. The first angle θ1 and the second angle θ2 are the same in this embodiment or may be different from each other. As shown in FIG. 4, from the viewpoint of workability, a fillet f may be disposed in a portion of the first lead-out part 21 connected to the first external electrode 30; however, the first angle θ1 is not measured in this fillet f. Specifically, the first angle θ1 is measured on the side surface of the first lead-out part 21 parallel to the direction of extension of the first lead-out part 21 when viewed in the axial direction L. The same applies to the second lead-out part 22.

Figure 5:
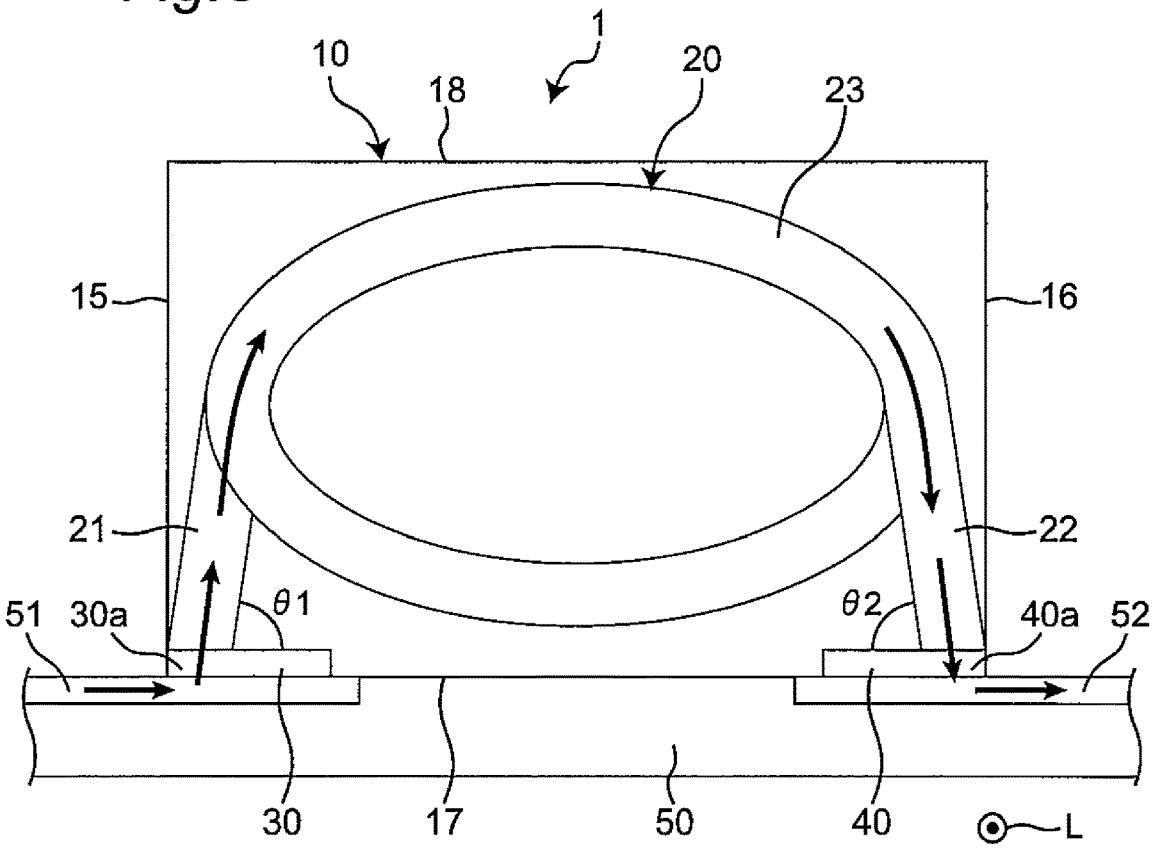
FIG. 5 is a simplified view of a state of the inductor component mounted on a mounting board.

According to the inductor component 1, the first end of the coil 20 is connected to the end portion 30*a* on the first end surface 15 side of the first external electrode 30, and the second end of the coil 20 is connected to the end portion 40*a* of the second end surface 16 side of the second external electrode 40. As shown in FIG. 5, when the inductor component 1 is mounted on a mounting board 50, the first external electrode 30 is connected to a first wiring 51 of the mounting board 50, and the second external electrode 40 is connected to a second wiring 52 of the mounting board 50. When a current is applied between the coil 20 and the mounting board 50, as indicated by arrows, the current flows near the end portion 30*a* of the first external electrode 30 into the coil 20 and flows near the end portion 40 of the second external electrode 40 before flowing out from the coil 20. Since this makes the line length of the current shorter in the first external electrode 30 and the second external electrode 40, an increase in loss can be suppressed and the Q value can be improved.

According to the inductor component 1, since the coil 20 has the winding part 23, the first lead-out part 21, and the second lead-out part 22, the shape design of the winding part 23 and the shape design of the first and second external electrodes 30, 40 can be made independent of each other, so that a degree of freedom in design is improved.

According to the inductor component 1, as shown in FIG. 5, when a current flows from the first wiring 51 of the mounting board 50 to the inductor component 1, for example, the current flows from the first end surface 15 side of the element body 10 toward the inside of the element body 10 through the first external electrode 30. The current then passes through the first external electrode 30 and flows through the first lead-out part 21. Since the first angle θ1 formed by the first lead-out part 21 and the first external electrode 30 is an acute angle, the direction of the current does not change at a sharp angle, so that a loss due to reflection and eddy current can be reduced.

On the other hand, when a current flows from the inductor component 1 to the second wiring 52 of the mounting board 50, the current passes through the second lead-out part 22 and the second external electrode 40 and flows from the inside of the element body 10 toward the second end surface 16 side of the element body 10. Since the second angle θ2 formed by the second lead-out part 22 and the second external electrode 40 is an acute angle, the direction of the current does not change at a sharp angle, so that a loss due to reflection and eddy current can be reduced.

Therefore, since the current can smoothly flow, an increase in the reflection loss of the current can be suppressed and the Q value can be improved. Although the current flows from the first external electrode in the order of the first lead-out part, the winding part, the second lead-out part, and the second external electrode in the description, the same applies when the current flows in the opposite direction.

According to the inductor component 1, the first external electrode 30 is exposed from the first end surface 15, and the second external electrode 40 is exposed from the second end surface 16. Consequently, when the inductor component 1 is mounted on the mounting board 50 by solder, the solder is bonded also on the first end surface 15 side of the first external electrode 30 and the second end surface 16 side of the second external electrode 40. Therefore, the fixing strength of the inductor component 1 to the mounting board 50 can be ensured.

Figure 6:
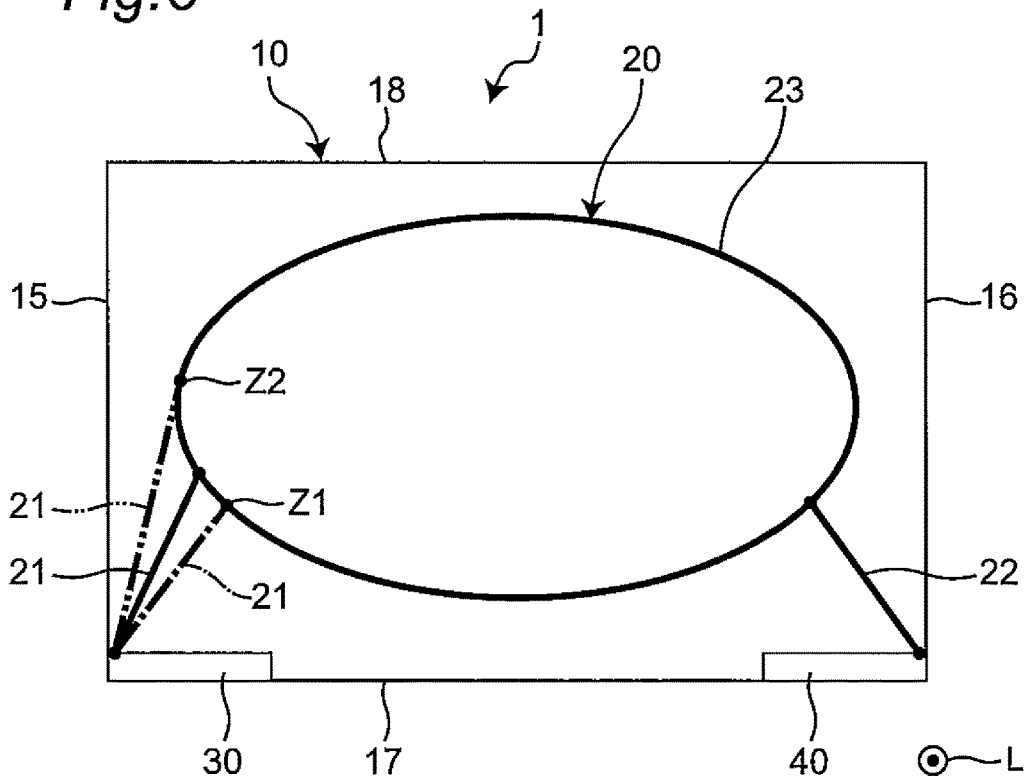
FIG. 6 is an explanatory view for explaining connection between first and second lead-out parts and a winding part.

In the inductor component 1, as shown in FIG. 6, when viewed in the axial direction L of the winding part 23, the first lead-out part 21 is preferably connected to the winding part 23 between a first position Z1 and a second position Z2. The first position Z1 is the position at which the first lead-out part 21 intersects the winding part 23 in the shortest distance as indicated by a dashed-dotted line. Therefore, the first position Z1 is a position at which the first lead-out part 21 is orthogonal to the tangent line of the outer circumference of the winding part 23. The second position Z2 is a position at which the first lead-out part 21 is tangent to the winding part 23. Therefore, the second position Z2 is a position at which the first lead-out part 21 coincides with the tangent line of the outer circumference of the winding part 23. Similarly, the second lead-out part 22 is connected to the winding part 23 between a first position at which the second lead-out part 22 intersects the winding part 23 in the shortest distance and a second position at which the second lead-out part 22 is tangent to the winding part 23.

According to the inductor component 1, when the first lead-out part 21 intersects the winding part 23 in the shortest distance, the length of the first lead-out part 21 can be minimized and a loss increase associated with an increase in the line length can be suppressed. On the other hand, when the first lead-out part 21 is tangent to the winding part 23, a current flow can be smoothened between the first lead-out part 21 and the winding part 23 as shown in FIG. 5.

Similarly, when the second lead-out part 22 intersects the winding part 23 in the shortest distance, the length of the second lead-out part 22 can be minimized and a loss increase associated with an increase in the line length can be suppressed. On the other hand, when the second lead-out part 22 is tangent to the winding part 23, a current flow can be smoothened between the second lead-out part 22 and the winding part 23 as shown in FIG. 5.

Therefore, when the first lead-out part 21 and the second lead-out part 22 are connected to the winding part 23 between the first position Z1 and the second position Z2, the line lengths of the first and second lead-out parts 21, 22 and the smoothness of the current flow can be balanced.

As shown in FIGS. 1 and 3, the first lead-out part 21 and the second lead-out part 22 extend from the bottom surface 17 of the element body 10 toward the top surface 18 of the element body 10. Therefore, the first lead-out part 21 is connected to the winding part 23 on the top surface 18 side, and the second lead-out part 22 is connected to the winding part 23 on the top surface 18 side. In this way, the coil 20 is formed such that the coil extends from the bottom surface 17 toward the top surface 18, is wound multiple times from the top surface 18, passing through the bottom surface 18 and returning to the top surface 18, and extends from the top surface 18 to the bottom surface 17.

Figure 7A:
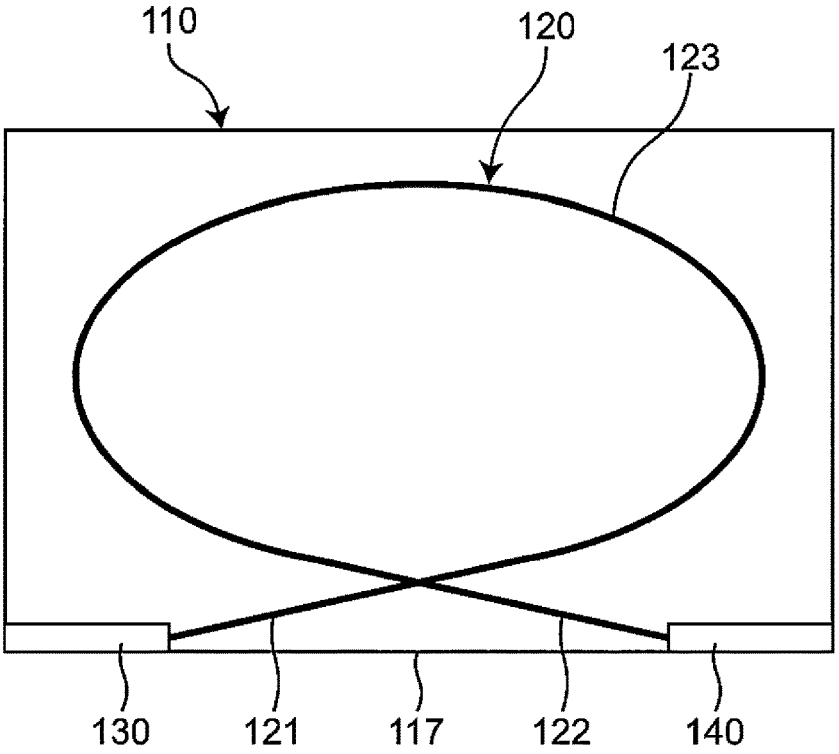
FIG. 7A is an explanatory view for explaining a comparative example of the inductor component.
Figure 7B:
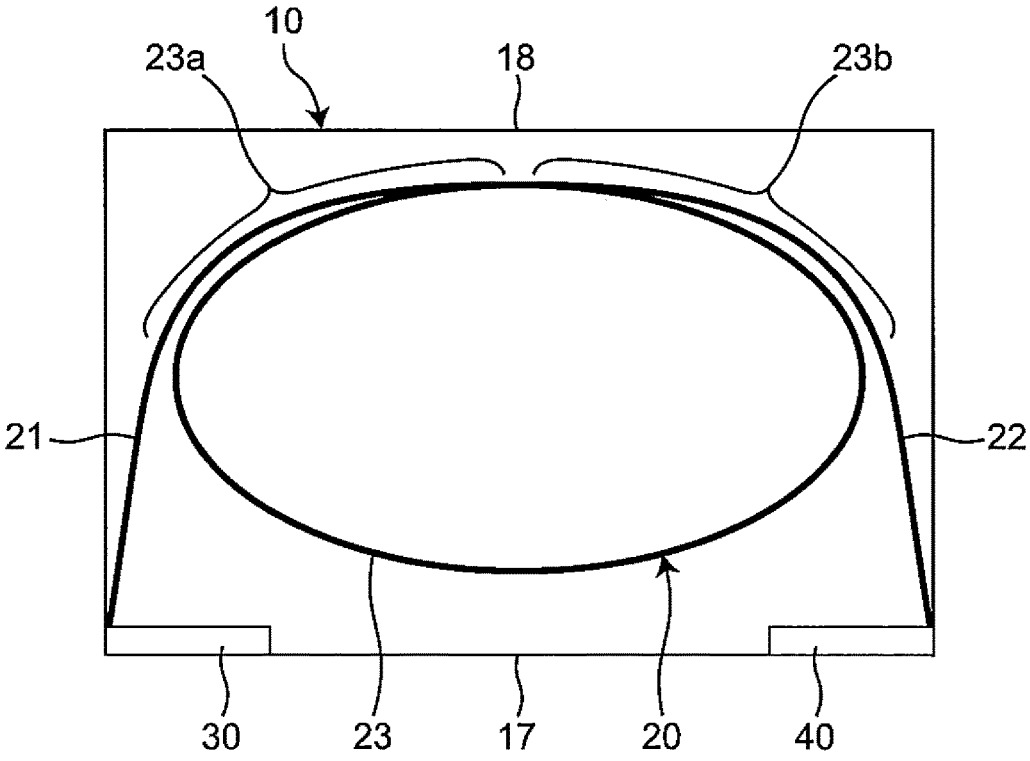
FIG. 7B is an explanatory view for explaining an effect of the inductor component of the present disclosure.

According to the inductor component 1, since the first lead-out part 21 and the second lead-out part 22 extend from the bottom surface 17 toward the top surface 18, the number of turns of the coil 20 can be increased as compared to when the first lead-out part and the second lead-out part extend along the bottom surface. This effect will hereinafter specifically be described with reference to FIGS. 7A and 7B. In FIGS. 7A and 7B, the number of turns of the coil is made smaller than the actual number of turns.

As shown in FIG. 7A, when a first lead-out part 121 of a coil 120 extends from a first external electrode 130 along a bottom surface 117 of an element body 110 and a second lead-out part 122 of the coil 120 extends from a second external electrode 140 along the bottom surface 117 of the element body 110, the number of turns of a winding part 123 of the coil 120 is one. On the other hand, as shown in FIG. 7B, when the first lead-out part 21 and the second lead-out part 22 extend from the bottom surface 17 toward the top surface 18, the number of turns of the winding part 23 is 1.5. Therefore, a first portion 23*a* and a second portion 23*b* of the winding part 23 become longer as compared to FIG. 7A.

Second Embodiment

Figure 8:
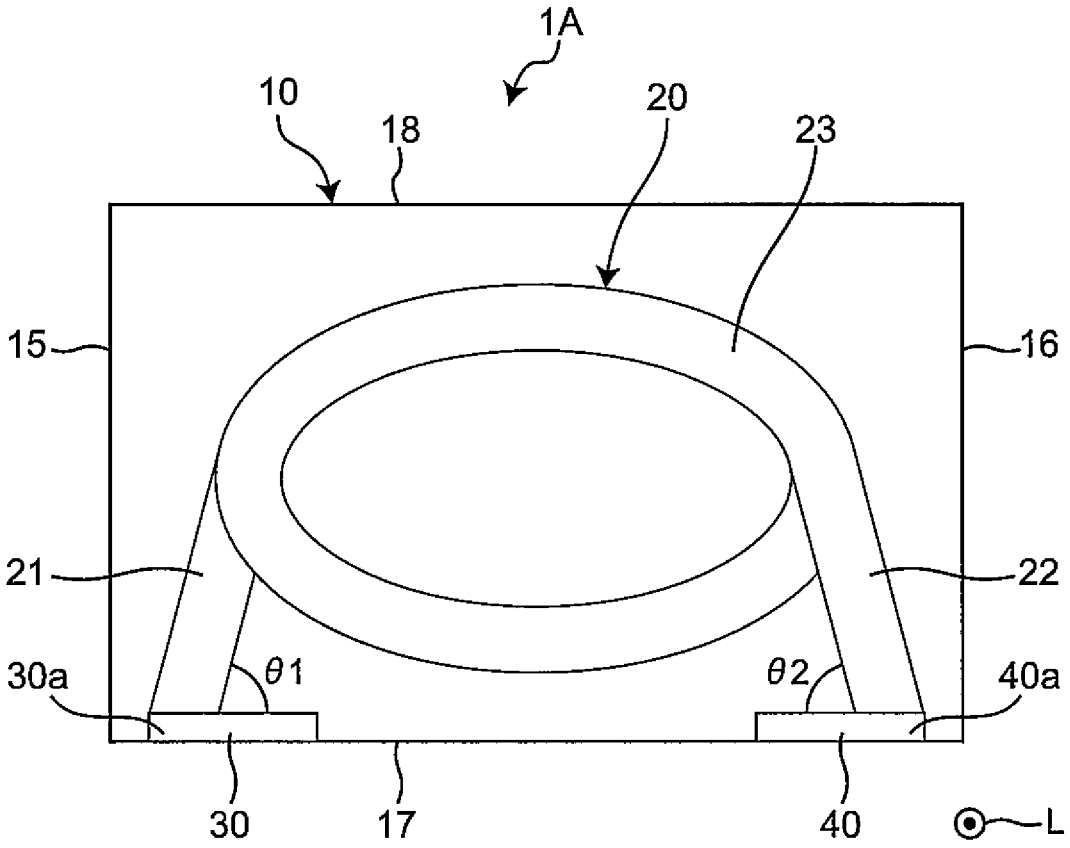
FIG. 8 is a simplified front view of a second embodiment of the inductor component of the present disclosure.

FIG. 8 is a simplified front view of a second embodiment of the inductor component of the present disclosure. The second embodiment is different from the first embodiment in the positions of the external electrodes. This different configuration will hereinafter be described. In the second embodiment, the same constituent elements as the first embodiment are denoted by the same reference numerals as the first embodiment and therefore will not be described.

As shown in FIG. 8, an inductor component 1A of the second embodiment has the first external electrode 30 covered with the first end surface 15 of the element body 10 and the second external electrode 40 covered with the end surface 16 of the element body 10. Therefore, the first and second external electrodes 30, 40 are exposed only from the bottom surface 17 of the element body 10.

According to the inductor component 1A, when the inductor component 1A is mounted on a mounting board by solder, the solder does not move up to wet the first end surface 15 side of the first external electrode 30 and the second end surface 16 side of the second external electrode 40. Therefore, the solder is present on the bottom surface 17 of the element body 10 without spreading outside the end surfaces 15, 16 of the element body 10, so that the mounting area of the inductor component 1A including the solder can be reduced with respect to the mounting board. In this case, the line lengths of the first and second wirings 51, 52 (see FIG. 5) of the mounting board 50 may become longer; however, the first and second wirings 51, 52 have lower resistance than the first and second external electrodes 30, 40, and an increase in loss is suppressed.

Third Embodiment

Figure 9A:
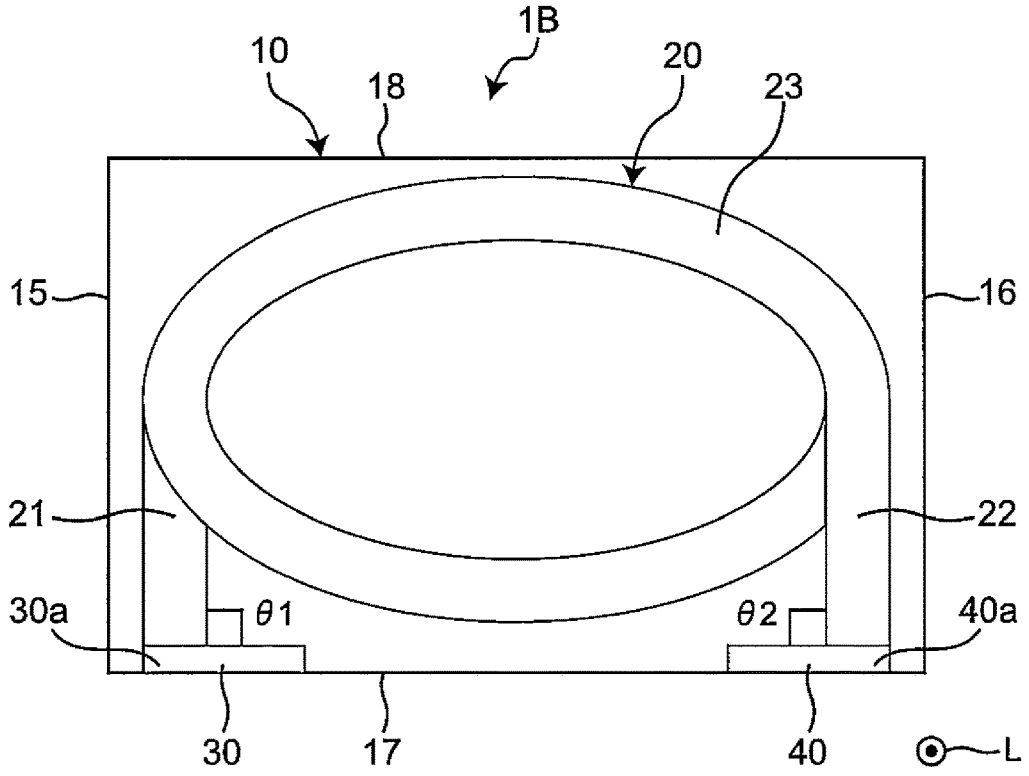
FIG. 9A is a simplified front view of a third embodiment of the inductor component of the present disclosure.
Figure 9B:
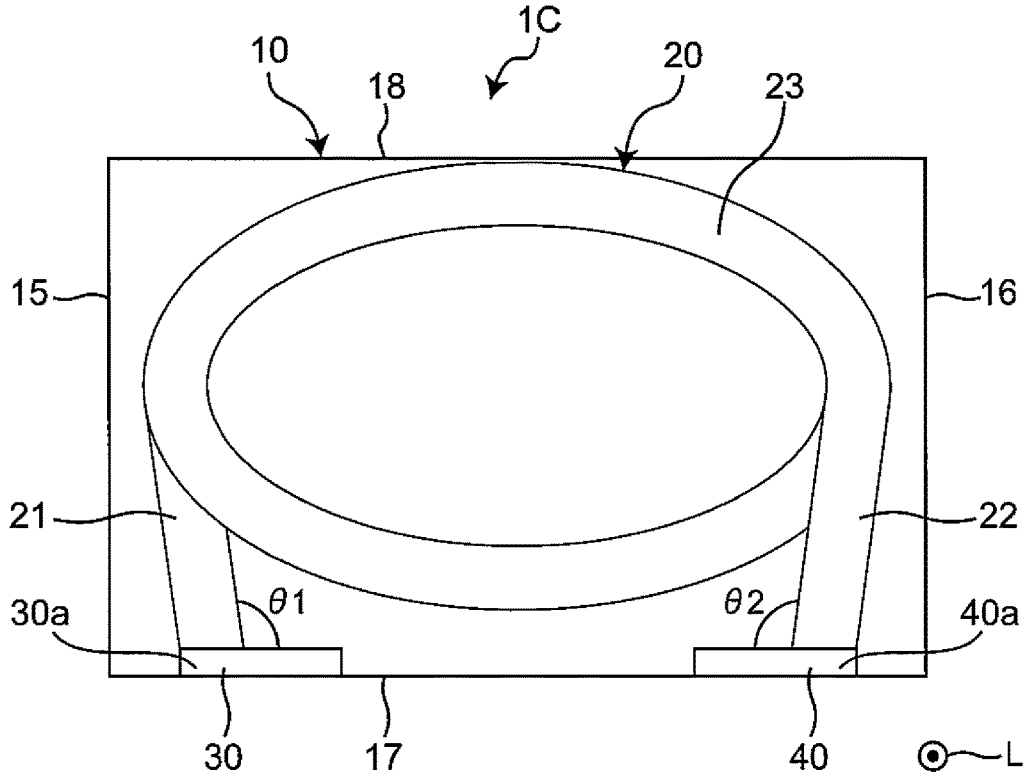
FIG. 9B is a simplified front view of the third embodiment of the inductor component of the present disclosure.

FIGS. 9A and 9B are simplified front views of a third embodiment of the inductor component of the present disclosure. The third embodiment is different from the second embodiment in magnitudes of the first and second angles. This different configuration will hereinafter be described. In the third embodiment, the same constituent elements as the second embodiment are denoted by the same reference numerals as the second embodiment and therefore will not be described.

As shown in FIG. 9A, in an inductor component 1B, when viewed in the axial direction L of the winding part 23, the first angle θ1 formed by the first lead-out part 21 and the first external electrode 30 and the second angle θ2 formed by the second lead-out part 22 and the second external electrode 40 are right angles. Therefore, the first and second external electrodes 30, 40 can be disposed under the winding part 23, and the distance between the first end surface 15 and the second end surface 16 of the element body 10 can be reduced.

As shown in FIG. 9B, in an inductor component 1C, when viewed in the axial direction L of the winding part 23, the first angle θ1 formed by the first lead-out part 21 and the first external electrode 30 and the second angle θ2 formed by the second lead-out part 22 and the second external electrode 40 are obtuse angles. Consequently, the first and second external electrodes 30, 40 can be arranged directly under the winding part 23, and the distance between the first end surface 15 and the second end surface 16 of the element body 10 can further be reduced. Thus, the first angle θ1 and the second angle θ2 are not limited to acute angles. An acute angle, a right angle, and an obtuse angle may be selected and combined as appropriate for the first and second angles θ1, θ2 such that, for example, the first angle θ1 is an acute angle while the second angle θ2 is a right angle or an obtuse angle.

Fourth Embodiment

Figure 10:
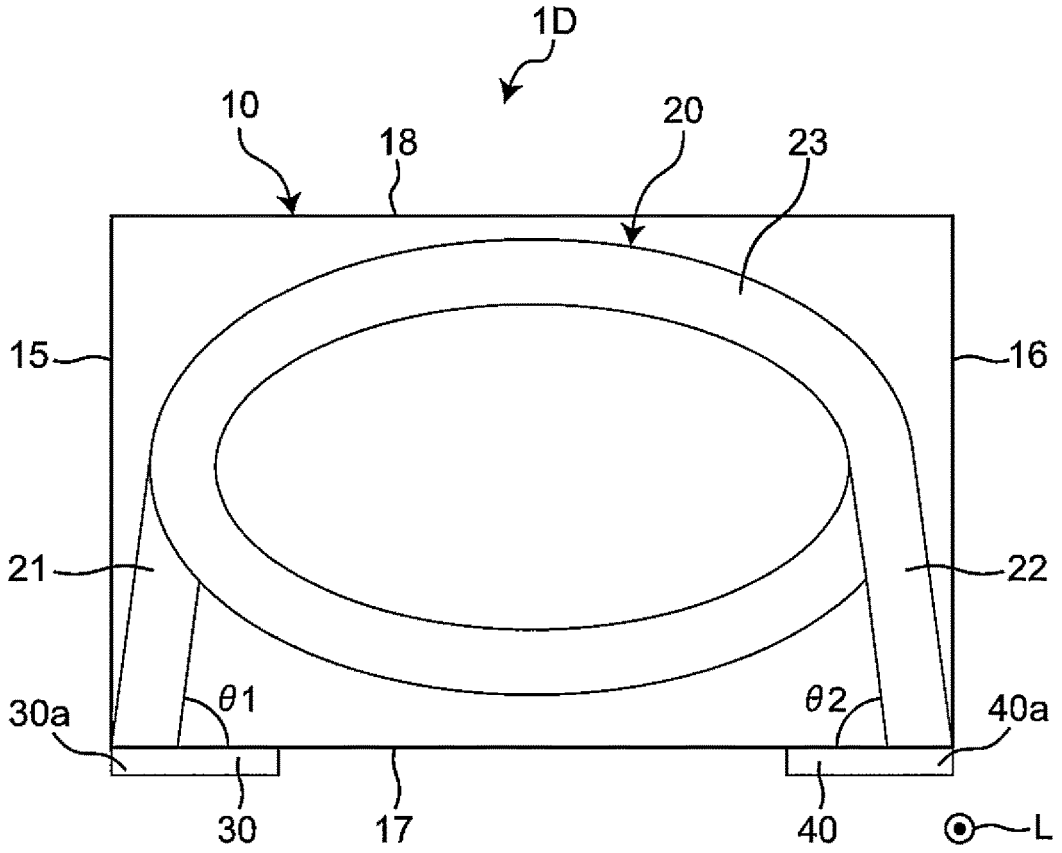
FIG. 10 is a simplified front view of a fourth embodiment of the inductor component of the present disclosure.

FIG. 10 is a simplified front view of a fourth embodiment of the inductor component of the present disclosure. The fourth embodiment is different from the first embodiment in the positions of the external electrodes. This different configuration will hereinafter be described. In the fourth embodiment, the same constituent elements as the first embodiment are denoted by the same reference numerals as the first embodiment and therefore will not be described.

As shown in FIG. 10, in an inductor component 1D, the first external electrode 30 and the second external electrode 40 are not embedded in the element body 10 and are disposed on the bottom surface 17 of the element body 10. Therefore, the first external electrode 30 and the second external electrode 40 are located outside the bottom surface 17 of the element body 10. Thus, the first and second external electrodes 30, 40 can externally be attached and formed onto the element body 10, and the first and second external electrodes 30, 40 can easily be manufactured.

The present disclosure is not limited to the embodiments and can be changed in design without departing from the spirit of the present disclosure. For example, respective feature points of the first to fourth embodiments may variously be combined. Although the external electrode are formed into a continuous flat plate shape by laminating the external electrode conductor layers in the embodiments, this is not a limitation and the external electrodes may be formed by connecting the adjacent external electrode conductor layers through vias.

Although made up of the laminated coil conductor layers in the embodiments, the coil may be made up of a wire such as an insulation-coated copper wire, etc. Although the coil has a configuration in which the multiple coil conductor layers having the number of turns less than one are laminated in the embodiments, the number of turns of the coil conductor layers may be one or more. Therefore, the coil may have a flat spiral shape.

Although having the lead-out parts in the embodiments, the coil may be made up only of the winding part contributing to generation of magnetic flux without disposing the lead-out parts. In this case, both ends of the winding part are directly connected to the external electrodes.

Although both the first and second external electrodes are exposed from the end surfaces or covered with the end surfaces in the embodiments, one external electrode may be exposed from the end surface and the other external electrode may be covered with the end surface.

Figure 11:
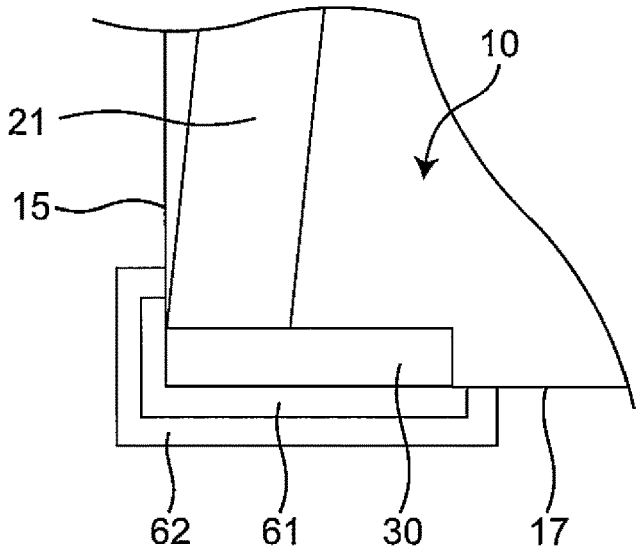
FIG. 11 is an enlarged view of a state of the first external electrode provided with plating.

Although the portions of the first and second external electrodes exposed from the element body are left as they are in the embodiments, the portions of the first and second external electrodes exposed from the element body may be plated. Specifically, as shown in FIG. 11, Sn plating 61 and Ni plating 62 are successively applied to the portion of the first external electrode 30 exposed from the first end surface 15 and the bottom surface 17. In this application, the platings 61, 62 are not included in the external electrode.

Although the axial direction of the winding part is the direction coincident with the lamination direction of the insulating layers in the embodiments, the axial direction of the winding part may be different from the lamination direction of the insulating layer. For example, the axis of the winding part may be orthogonal to the end surfaces of the element body, or the axis of the winding part may be orthogonal to the bottom surface of the element body.

Figure 12:
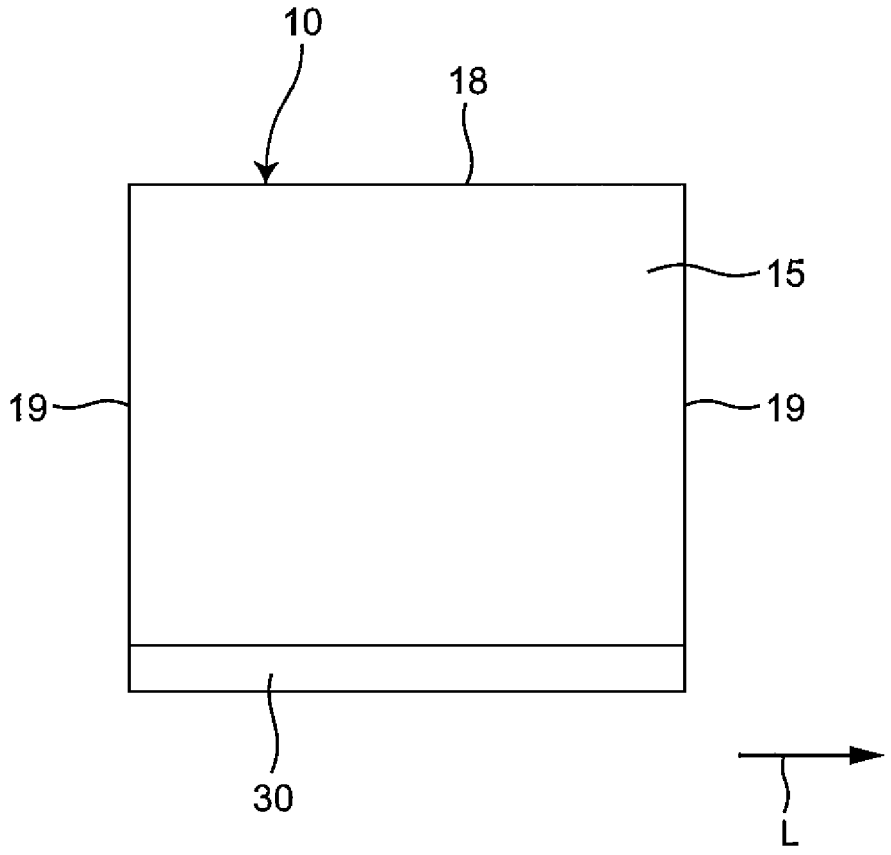
FIG. 12 is an end view of a state of the first external electrode exposed from a side surface of an element body.

Although the external electrodes are not exposed from the side surfaces opposite to each other in the coil axis direction of the element body in the embodiments, the external electrodes may be exposed from the side surfaces of the element body. Specifically, as shown in FIG. 12, when viewed from the first end surface 15 side of the element body 10, both ends of the first external electrode 30 are exposed from both side surfaces 19 opposed to each other in the axial direction L of the element body 10. Similarly, both ends of the second external electrode are exposed from both of the side surfaces 19 of the element body 10. In this case, the external electrode conductor layers 33, 43 are also disposed in the insulating layers 11 at both ends in the laminating direction A shown in FIG. 2.

Example

An example of a method of manufacturing the inductor component 1 will hereinafter be described.

First, an insulating layer is formed by repeatedly applying an insulating paste mainly composed of borosilicate glass onto abase material such as a carrier film by screen printing. This insulating layer serves as an outer-layer insulating layer located outside coil conductor layers. The base material is peeled off from the insulating layer at an arbitrary step and does not remain in the inductor component state.

Subsequently, a photosensitive conductive paste layer is applied and formed on the insulating layer to form a coil conductor layer and an external electrode conductor layer by a photolithography step. Specifically, the photosensitive conductive paste containing Ag as a main metal component is applied onto the insulating layer by screen printing to form the photosensitive conductive paste layer. Ultraviolet rays, etc. are then applied through a photomask to the photosensitive conductive paste layer and followed by development with an alkaline solution, etc. As a result, the coil conductor layer and the external electrode conductor layer are formed on the insulating layer. At this step, the coil conductor layer and the external electrode conductor layer can be drawn into a desired pattern with the photomask. In this case, a first end of the coil conductor layer (coil) is connected to an end portion on the outer edge side of the insulating layer (the end surface side of the element body) in the external electrode conductor layer (external electrode).

A photosensitive insulating paste layer is applied and formed on the insulating layer to form an insulating layer provided with an opening and a via hole by a photolithography step. Specifically, a photosensitive insulating paste is applied onto the insulating layer by screen printing to form the photosensitive insulating paste layer. Ultraviolet rays, etc. are then applied through a photomask to the photosensitive insulating paste layer and followed by development with an alkaline solution, etc. At this step, the photosensitive insulating paste layer is patterned so as to dispose the opening above the external electrode conductor layer and the via hole at an end portion of the coil conductor layer with the photomask.

Subsequently, a photosensitive conductive paste layer is applied and formed on the insulating layer provided with the opening and the via hole to form a coil conductor layer and an electrode conductor layer by a photolithography step. Specifically, a photosensitive conductive paste containing Ag as a main metal component is applied onto the insulating layer so as to fill the opening and the via hole by screen printing to form the photosensitive conductive paste layer. Ultraviolet rays, etc. are then applied through a photomask to the photosensitive conductive paste layer and followed by development with an alkaline solution, etc. This leads to the formation of the external electrode conductor layer connected through the opening to the external electrode conductor layer on the lower layer side and the coil conductor layer connected through the via hole to the coil conductor layer on the lower layer side.

The steps of forming the insulating layer as well as the coil conductor layer and the external electrode conductor layer as described above are repeated to form a coil made up of the coil conductor layers formed on the multiple insulating layers and external electrodes made up of the electrode conductor layers formed on the multiple insulating layers. An insulating layer is further formed by repeatedly applying an insulating paste by screen printing onto the insulating layer with the coil and the external electrodes formed. This insulating layer serves as an outer-layer insulating layer located outside the coil conductor layers. It is noted that if sets of coils and external electrodes are formed in a matrix shape on the insulating layers at the steps described above, a mother laminated body can be acquired.

Subsequently, the mother laminated body is cut into multiple unfired laminated bodies by dicing, etc. At the step of cutting the mother laminated body, the external electrodes are exposed from the mother laminated body on a cut surface formed by cutting. At this step, if a cut deviation occurs in a certain amount or more, the outer circumferential edges of the coil conductor layers formed at the steps appear on an end surface or a bottom surface.

The unfired laminated bodies are fired under predetermined conditions to acquire element bodies including the coils and the external electrodes. These element bodies are subjected to barrel finishing for polishing into an appropriate outer shape size, and portions of the external electrodes exposed from the laminated bodies are subjected to Ni plating having a thickness of 2 μm to 10 μm and Sn plating having a thickness of 2 μm to 10 μm. Through the steps described above, inductor components of 0.4 mm×0.2 mm×0.2 mm are completed.

The construction method of forming the inductor component is not limited to the above method and, for example, the method of forming the coil conductor layers and the external electrode conductor layers may be a printing lamination construction method of a conductive paste using a screen printing plate opened in a conductor pattern shape, may be a method using etching or a metal mask for forming a pattern of a conductive film formed by a sputtering method, a vapor deposition method, pressure bonding of a foil, etc., or may be a method in which formation of a negative pattern is followed by formation of a conductor pattern with a plating film and subsequent removal of unnecessary portions as in a semi-additive method. Alternatively, the method may be achieved by using a method of transferring onto an insulating layer a conductor patterned on a substrate different from the insulating layer serving as the element body of the inductor component.

The method of forming the insulating layers as well as the openings and the via holes is not limited to the above method and may be a method in which after pressure bonding, spin coating, or spray application of an insulating material sheet, the sheet is opened by laser or drilling. If the end portions of the external electrodes are exposed from the side surfaces of the element body, the external electrode conductor layers may be formed in the outer-layer insulating layers.

The insulating material of the insulating layers is not limited to the ceramic material such as glass and ferrite as described above and may be an organic material such as an epoxy resin, a fluororesin, and a polymer resin, or may be a composite material such as a glass epoxy resin and, if the inductor component is used for a matching coil at high frequency, a material low in dielectric constant and dielectric loss is desirable.

The size of the inductor component is not limited to the above description. The method of forming the external electrodes is not limited to the method of applying plating to the external electrodes exposed by cutting, and may be a method in which a coating film is further formed by dipping of a conductor paste, a sputtering method, etc. on the external electrodes exposed by cutting, or plating may further be applied thereon. As in the case of forming the coating film or plating, the external electrodes may not be exposed to the outside of the electronic component. Therefore, the exposure of the external electrodes from the element body means that the external electrodes have portions not covered with the element body and the portions may be exposed to the outside of the electronic component or may be exposed to other members.

The invention claimed is:

1. An inductor component comprising:

an element body;

a coil disposed in the element body; and first and second external electrodes disposed in the element body and electrically connected to the coil, wherein the element body includes a first end surface and a second end surface opposite to each other and a bottom surface connected between the first end surface and the second end surface, wherein the first external electrode is formed on the first end surface side of the bottom surface while the second external electrode is formed on the second end surface side of the bottom surface, and wherein a first end of the coil is connected to an end portion on the first end surface side of the first external electrode at an edge of the first external electrode in an opposing direction of the first end surface and the second end surface while a second end of the coil is connected to an end portion on the second end surface side of the second external electrode at an edge of the second external electrode in the opposing direction of the first end surface and the second end surface.

2. The inductor component according to claim 1, wherein the coil has a winding part wound in a helical shape, a first lead-out part connected between a first end of the winding part and the end portion on the first end surface side of the first external electrode, and a second lead-out part connected between a second end of the winding part and the end portion on the second end surface side of the second external electrode.

3. The inductor component according to claim 2, wherein when viewed in a direction parallel to the first end surface, the second end surface, and the bottom surface, an angle formed by the first lead-out part and the first external electrode and an angle formed by the second lead-out part and the second external electrode are acute angles.

4. The inductor component according to claim 2, wherein the winding part is helically wound in an axial direction parallel to the bottom surface.

5. The inductor component according to claim 4, wherein when viewed in the axial direction of the winding part, the first lead-out part is connected to the winding part between a first position at which the first lead-out part intersects the winding part in a shortest distance and a second position at which the first lead-out part is tangent to the winding part, and wherein the second lead-out part is connected to the winding part between a first position at which the second lead-out part intersects the winding part in a shortest distance and a second position at which the second lead-out part is tangent to the winding part.

6. The inductor component according to claim 2, wherein the winding part is helically wound in an axial direction parallel to the first end surface, the second end surface, and the bottom surface.

7. The inductor component according to claim 6, wherein the first lead-out part and the second lead-out part extend from the bottom surface of the element body toward a top surface opposite to the bottom surface of the element body.

8. The inductor component according to claim 2, wherein the winding part includes a coil conductor layer wound in a planar shape.

9. The inductor component according to claim 1, wherein the first external electrode is exposed from the first end surface of the element body while the second external electrode is exposed from the second end surface of the element body.

10. The inductor component according to claim 1, wherein the first external electrode is covered with the first end surface of the element body while the second external electrode is covered with the second end surface of the element body.

* * * * *